US008021113B2

(12) United States Patent
Routier

(10) Patent No.: US 8,021,113 B2
(45) Date of Patent: Sep. 20, 2011

(54) TWIN-AIRFOIL BLADE WITH SPACER STRIPS

(75) Inventor: Pascal Routier, Le Mee sur Seine (FR)

(73) Assignee: SNECMA, Paris (FR)

( * ) Notice: Subject to any disclaimer, the term of this patent is extended or adjusted under 35 U.S.C. 154(b) by 456 days.

(21) Appl. No.: 12/351,323

(22) Filed: Jan. 9, 2009

(65) Prior Publication Data

US 2009/0220348 A1 Sep. 3, 2009

(30) Foreign Application Priority Data

Jan. 10, 2008 (FR) ..... 08 50120

(51) Int. Cl.
*F01D 5/30* (2006.01)

(52) U.S. Cl. ..... 416/96 R; 416/219 A; 416/219 R; 416/223 A; 416/223 R; 416/246

(58) Field of Classification Search ..... 416/96 A, 416/96 R, 97 A, 97 R, 213, 219 R, 223 A, 416/223 R, 228, 246, 248, 500
See application file for complete search history.

(56) References Cited

U.S. PATENT DOCUMENTS

| | | | | |
|---|---|---|---|---|
| 2,714,499 | A * | 8/1955 | Warner | 416/243 |
| 3,040,971 | A * | 6/1962 | Pavlecka | 415/1 |
| 3,164,367 | A * | 1/1965 | Lynch | 416/92 |
| 3,335,483 | A * | 8/1967 | Howald | 29/889.22 |
| 3,388,888 | A * | 6/1968 | Kercher et al. | 415/115 |
| 3,692,425 | A | 9/1972 | Erwin | |
| 3,883,268 | A * | 5/1975 | Evans et al. | 416/223 R |
| 3,957,392 | A * | 5/1976 | Blackburn | 415/146 |
| 4,195,396 | A * | 4/1980 | Blazek | 29/889 |
| 4,464,094 | A * | 8/1984 | Gerken | 415/209.4 |
| 5,088,894 | A * | 2/1992 | Patel | 416/219 R |
| 5,257,908 | A | 11/1993 | Ortolano | |
| 5,368,440 | A * | 11/1994 | Japikse et al. | 415/208.3 |
| 5,524,341 | A * | 6/1996 | Ferleger et al. | 29/889.7 |
| 5,797,725 | A * | 8/1998 | Rhodes | 415/209.2 |
| 5,873,696 | A * | 2/1999 | Harada et al. | 415/148 |
| 6,599,092 | B1 * | 7/2003 | Manning et al. | 416/97 R |
| 7,195,454 | B2 * | 3/2007 | Lu et al. | 415/181 |
| 7,387,487 | B2 * | 6/2008 | Guemmer | 415/115 |
| 7,520,728 | B2 * | 4/2009 | Sleiman et al. | 416/223 R |

FOREIGN PATENT DOCUMENTS

| | | |
|---|---|---|
| EP | 0 781 929 A1 | 7/1997 |
| FR | 2 574 113 | 6/1986 |
| WO | 2005/040559 A1 | 5/2005 |

* cited by examiner

*Primary Examiner* — Michael Lebentritt
(74) *Attorney, Agent, or Firm* — Oblon, Spivak, McClelland, Maier & Neustadt, L.L.P.

(57) ABSTRACT

The invention relates to a blade possessing a leading edge and a trailing edge, the blade comprising a first airfoil possessing an inner face and an outer face extending between said leading edge and said trailing edge, a second airfoil possessing an inner face and an outer face extending between said leading edge and said trailing edge, and at least one spacer strip interconnecting said inner face of the first airfoil and said inner face of the second airfoil, said at least one strip extending to said trailing edge, the distance between the inner face of the first airfoil and the inner face of the second airfoil being of the same order of magnitude as the maximum thickness of the first or the second airfoil.

14 Claims, 2 Drawing Sheets

TWIN-AIRFOIL BLADE WITH SPACER STRIPS

FIELD OF THE INVENTION

The present invention relates to a blade possessing a leading edge and a trailing edge.

In the description below, the terms "leading edge" and "trailing edge" are defined relative to the normal flow direction of air along the blade.

BACKGROUND OF THE INVENTION

In a turbomachine, air is compressed by a plurality of blade stages disposed axially along the main axis P of the turbomachine, each stage comprising a series of blades disposed around a circumference about said main axis P. Such a stage is known as a bladed wheel. From a circumferential platform centered on the main axis P, the blades extend outwards substantially radially towards an annular casing. The height of a blade is the radial dimension of the blade, i.e. substantially the difference between the radius of the casing and the radius of the platform.

As shown in FIG. 1, which shows a portion of a bladed wheel, each blade 1 of the bladed wheel extends between the radially-outer surface (wall) 81 of the platform 80 and the radially-inner surface (wall) 91 of the casing 90. Since the blade 1 is constituted by a single airfoil, it is referred to as a single-airfoil blade. The radially-inner end 8 of the blade 1 is secured to the platform 80. The radially-outer end 9 of the blade 1 is fastened to the casing 90 if it constitutes a stator vane, and otherwise it is free if it constitutes a rotor blade. The bladed wheel thus has blades 1 lying between said wall 81 of the platform 80 and said wall 91 of the casing 90, which blades may be stator vanes 1 or rotor blades 1.

Each blade 1 possesses a leading edge 2 and a trailing edge 3, with the axis A (axis of the blade) interconnecting these two edges being substantially parallel to the main axis P of the turbomachine. Each blade 1 is curved relative to its axis A so that one of its faces interconnecting its leading edge 2 and its trailing edge 3 is convex (convex face 4), while the other face interconnecting its leading edge and its trailing edge is concave (concave face 5).

The number of blades on a bladed wheel is determined as a compromise between obtaining low weight for the bladed wheel, obtaining high mechanical strength for a blade (when subjected to thermal stresses and to mechanical stresses due to the bladed wheel rotating at high speed), and maximizing the aerodynamic efficiency of a blade, and consequently the aerodynamic efficiency of the bladed wheel. At present, the geometry of blades does not enable any significant improvement to be achieved in the aerodynamic performance of a bladed wheel carrying such blades.

OBJECT AND SUMMARY OF THE INVENTION

The invention seeks to provide blades that provide better aerodynamic efficiency, without compromising the mechanical strength of the blades.

This object is achieved by the fact that the blade comprises a first airfoil possessing an inner face and an outer face extending between the leading edge and the trailing edge of the blade, a second airfoil possessing an inner face and an outer face extending between its leading edge and its trailing edge, the first airfoil and the second airfoil being in side by side alignment such that, over substantially its entire area, said inner face of the first airfoil faces said inner face of the second airfoil, and at least one spacer strip interconnecting the inner face of the first airfoil and the inner face of the second airfoil, the at least one strip extending to the trailing edge.

By means of these dispositions, the blade of the invention presents greater mechanical strength than a blade constituted by a single airfoil. This increased mechanical strength enables the mean thickness of each of the airfoils constituting the blades to be reduced. This reduction in thickness leads to improving the aerodynamic efficiency of the blade, since the natural flow of air passing around the airfoils is less disturbed. In addition, the strips guide air between the two airfoils, with the guided air itself contributing to guide the air that flows along the outer walls of the two airfoils at the trailing edge of the blade, in particular because the strips extend as far as the trailing edge of the blade. This minimize turbulence in the flow at the trailing edge. Consequently, the aerodynamic efficiency of the blade is further improved.

Advantageously, the blade has a minimum of three strips. This larger number of strips serves to stiffen the blade better, and to provide better guidance to the flow of air in the space between the first airfoil and the second airfoil.

The invention also provides a bladed wheel including a series of blades of the invention around its circumference.

The improvement in the aerodynamic efficiency of each of the blades of the invention (compared with a single-airfoil blade) as made possible by the geometry of the blades of the invention, allows the blades to be spaced more widely apart around the circumference of the platform of the bladed wheel compared with the spacing between the single-airfoil blades on a prior art bladed wheel. Overall, in spite of the fact that an individual blade of the invention may be heavier than a single-airfoil blade, a bladed wheel of the invention can nevertheless present weight that is equal to or less than the weight of a bladed wheel fitted with single-airfoil blades, and it can provide greater efficiency.

BRIEF DESCRIPTION OF THE DRAWINGS

The invention can be well understood and its advantages appear better on reading the following detailed description of an embodiment given by way of non-limiting example. The description refers to the accompanying drawings, in which.

MORE DETAILED DESCRIPTION

Figure 1:
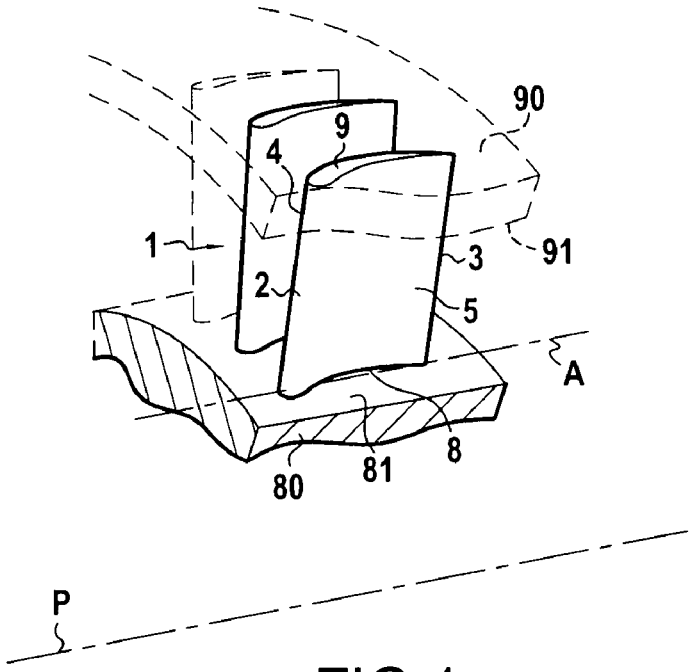
FIG. 1 is a perspective view of prior art blades.
Figure 2:
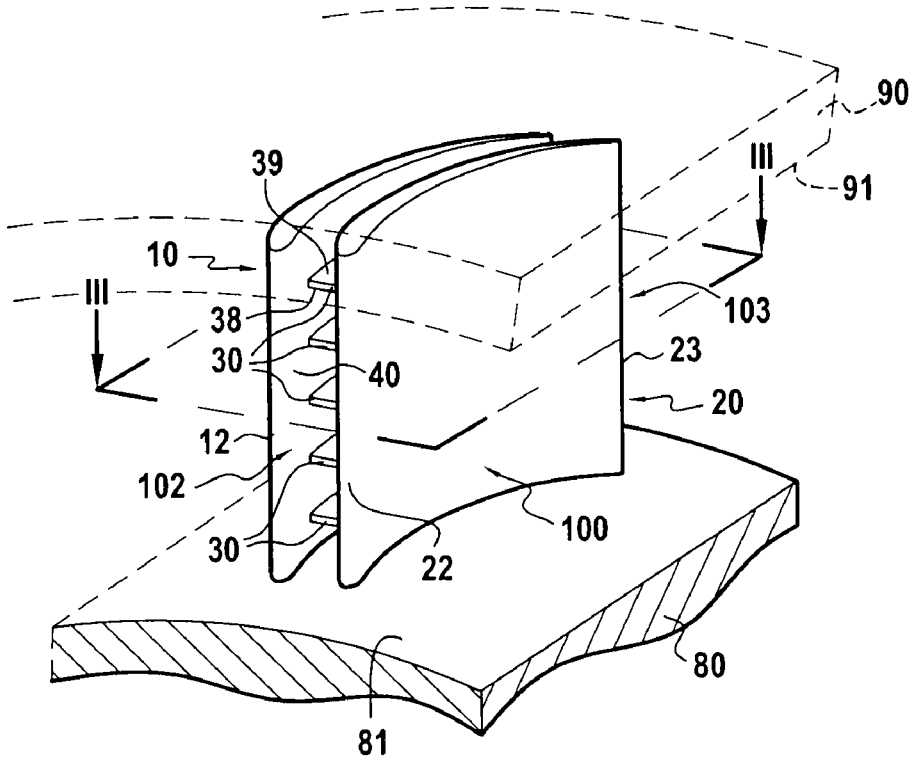
FIG. 2 is a perspective view of a blade of the invention.
Figure 3:
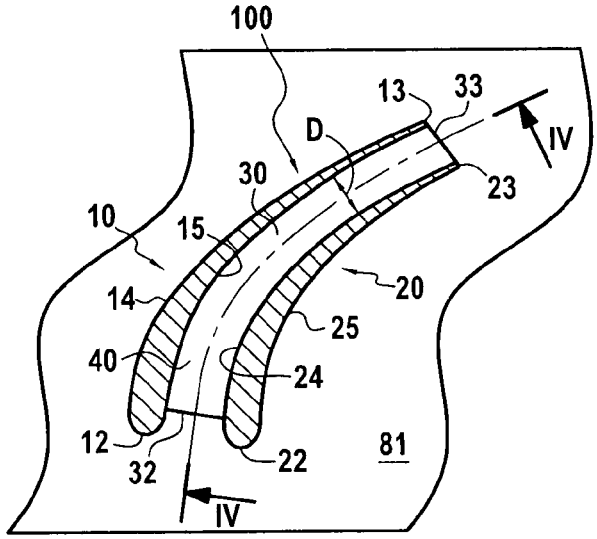
FIG. 3 is a cross-section on plane III-III of the FIG. 2 blade.

FIG. 2 shows a blade 100 of the invention mounted on a platform 80. The blade 100 comprises a first airfoil 10 and a second airfoil 20, each of these airfoils being similar to a single-airfoil blade and thus possessing a convex face, a concave face, a leading edge, and a trailing edge. These two airfoils are in side-by-side alignment so that, over substantially its entire area, the concave face 15 of the first airfoil 10 faces, the convex face 24 of the second airfoil 20. A space 40 is thus defined between the first blade 10 and the second blade 20. The concave face 15 is thus referred to as the inner face 15 of the first airfoil 10, and the convex face 24 is thus referred to as the inner face 24 of the second airfoil 20. The convex face 14 of the first airfoil 10 and the concave face 25 of the second airfoil 20 constitute the outer faces of the blade 100. The convex face 14 is therefore referred to as the outer face 14 of the first airfoil 10, and the concave face 15 is referred to as the outer face 15 of the second airfoil 20. The blade 10 is therefore referred to as a twin-airfoil blade.

The inner face 15 of the first airfoil 10 and the inner face 24 of the second airfoil 20 are interconnected by one or more spacer strips 30 disposed in the space 40. Each strip possesses a leading edge 22, a trailing edge 23, and, between them, a central portion with a radially-inner face 38 (i.e. facing towards the platform 80) and a radially-outer face 39 (i.e. facing towards the casing 90).

Each strip 30 is a continuous connecting element that interconnects the two inner faces, the connecting element forming both reinforcement that contributes to the mechanical strength and cohesion of the blade 100, and a guide along its radially-inner face 38 and its radially-outer face 39 for guiding the flow of air between the first airfoil 10 and the second airfoil 20. The inside of each strip 30 may be hollow or solid.

The strips 30 extend substantially from the leading edge 12 of the first airfoil 10 and the leading edge 22 of the second airfoil 20 to the trailing edge 13 of the first airfoil 10 and the trailing edge 23 of the second airfoil 20. The leading edge 102 of the blade 100 is thus constituted by the leading edges 12 and 22 of the first airfoil 10 and of the second airfoil 20, respectively. The trailing edge 103 of the blade 100 is constituted by the trailing edges 13 and 23 of the first airfoil 10 and of the second airfoil 20, respectively. Along the direction from the leading edge 102 towards the trailing edge 103, the strips 30 are oriented substantially perpendicularly to the leading edge 102 and to the trailing edge 103.

Since the blade 100 comprises two airfoils, it possesses mechanical strength that is greater than that of a single-airfoil blade. This increased strength enables the mean thickness of each of the airfoils constituting the blade 100 to be reduced, i.e. each of the first and second airfoils 10 and 20 present smaller thickness than would be presented by a single-airfoil blade. The total weight of the blade 100 may even be substantially equal to the weight of a single-airfoil blade 1. In addition, as explained above, the blade 100 presents better aerodynamic efficiency than does a single-airfoil blade, because of the strips 30. On a bladed wheel having blades 100 of the invention, this improvement in aerodynamic efficiency allows the blades 100 to be spaced further apart from one another around the circumference of the platform 80 of the bladed wheel, compared with the spacing between single-airfoil blades on a prior art bladed wheel. To sum up, a bladed wheel of the invention may thus be of weight that is equal to or less than the weight of a bladed wheel fitted with single-airfoil blades. This results in a decrease in the weight of a turbomachine fitted with bladed wheels of the invention, and thus to a decrease in its fuel consumption.

In addition, the blade 100 of the invention presents greater ability to withstand high temperatures than does a single-airfoil blade, since the blade 100 possesses a larger heat exchange area than does a single-airfoil blade.

The blade 100 may have a plurality of strips 30, for example the blade may include a minimum of three strips, with a first strip $\mathbf{30}_A$ situated in the range 0% to 30% of the height of the blade 100, a last strip $\mathbf{30}_N$ situated in the range 70% and 100% of the height of the blade 100, and a strip situated substantially in the middle of the height of the blade 100, and where a height of 0% corresponds to the radially-inner end of the blade and a height of 100% corresponds to the radially-outer end of the blade. Where appropriate, additional strips are situated at regular intervals between the above strips.

It is important for the first strip $\mathbf{30}_A$ not to be too far away from the platform 80 (specifically less than 30% of the height of the blade 100) in order to be more effective in decreasing the turbulence generated in the flow by the radially-outer surface 81 of the platform 80. Similarly, it is important for the last strip $\mathbf{30}_N$ not to be far too far away from the casing 90 (specifically at least 70% of the height of the blade 100) in order to be more effective in decreasing the turbulence generated in the flow by the radially-inner surface 91 of the casing 90.

The blade 100 may have a number of strips that is greater than three, for example, four, five, six, seven, or more distributed over its entire height. FIGS. 2 to 5 show a blade 100 having five strips 30. In order to allow a sufficient flow of air to pass between the first airfoil 10 and the second airfoil 20, and in order to minimize the weight of the blade 100, it is nevertheless preferable for the number of strips not to be too great. Thus, it is preferable for the radial distance between two adjacent strips 30 to be greater than the distance D between the inner face 15 of the first airfoil 10 and the inner face 24 of the second airfoil 20.

The distance D between the inner face 15 of the first airfoil 10 and the inner face 24 of the second airfoil 20 is equal to no more than three times the maximum thickness of the first or the second airfoil. For example, the distance D is may be of the same order of magnitude as said maximum thickness.

The distance D between the first airfoil 10 and the second airfoil 20 is preferably less than 15 millimeters (mm). For example, the distance D may lie in the range 2 mm to 5 mm. This distance D may vary along the strip 30 between its leading edge 32 and its trailing edge 33, in which case the distance D is the mean distance between the two airfoils.

Advantageously, in a bladed wheel having blades 100, each of the strips 30 possesses a profile such that the turbulence/vortices in the flow of air along said strip 30 is/are minimized. For example, the strips 30 extend substantially along the streamlines that would be followed by the flow of air in the space 40 between the first airfoil 10 and the second airfoil 20 if the strips 30 were not present, in order to minimize disturbance to this flow of air.

In particular, the profile and the disposition of the first strip $\mathbf{30}_A$, i.e. the strip closest to the wall (radially-outer surface 81) of the platform 80, and the profile and the disposition of the last strip $\mathbf{30}_N$, i.e. the strip closest to the wall (radially-inner surface 91) of the casing 90, are of particular importance.

Figure 4:
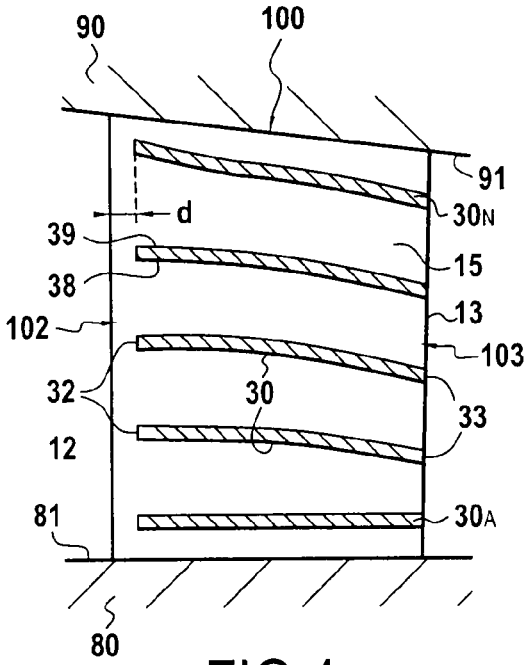
FIG. 4 is a longitudinal section on plane IV-IV of the FIG. 3 blade.
Figure 5:
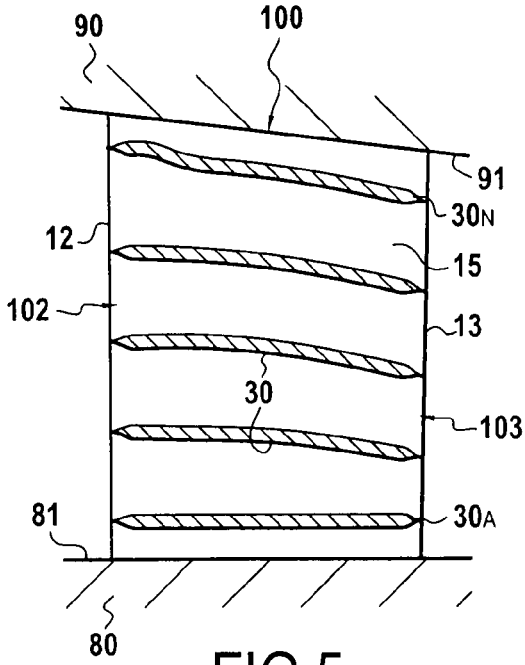
FIG. 5 is a longitudinal section of another embodiment of the FIG. 3 blade.

The streamlines of the flow between the airfoils are defined in particular by the wall 81 of the platform 80 and the wall 91 of the casing 90, respectively at the radially-inner and radially-outer ends of the blade, i.e. the streamlines close to these walls are substantially parallel to said walls. Thus, the first strip $\mathbf{30}_A$ is substantially parallel to the wall 81 of the platform 80, and the last strip $\mathbf{30}_N$ is substantially parallel to the wall 91 of the casing 90, as shown in FIGS. 4 and 5.

For example, at least one of the strips 30 is rectilinear.

By way of example, at least one of the strips 30 possesses curvature in at least one plane extending in the height direction of said blade (i.e. a radial plane containing the main axis P of the turbomachine).

It is also possible for the strips 30 not to follow the flow of air in the space 40 as would occur if the strips 30 were not present, and on the contrary for these strips to force the air to flow more towards the roots of the blades 100. As a general rule, it is known that divergence occurs in the flow of air between two blades (i.e. the flow of air passing between two adjacent blades tends to rise from the root towards the tip of the blade as it flows along the blades), and that this is undesirable. By forcing the air flow in the space 40 to flow more towards the root of the blade 100, the flow of air between two adjacent blades 100 is influenced, thereby contributing to reducing the divergence in this flow of air.

In FIGS. 2 and 4, each of the strips 30 is shown as having constant thickness between its leading edge 32 and its trailing edge 33 (where the thickness of a strip 30 is its dimension in the height direction of the blade 100 to which it belongs). Consequently, the leading edges 32 and the trailing edges 33 of the strips 30 are substantially rectangular. Alternatively, the thickness of a strip 30 may diminish going from its middle towards its leading edge 32 so that the leading edge 32 forms a sharp edge. Furthermore, or alternatively, the thickness of a strip 30 may diminish going from its middle towards its trailing edge 33 such that the trailing edge 33 forms a sharp edge. As a result, the disturbance to the flow of air in the space 30 between the first airfoil 10 and the second airfoil 20 is diminished compared with the disturbance produced by a strip of constant thickness.

This reduction in the thickness of the strip 30 may be progressive, or else the thickness may be substantially constant along the strip 30 and decrease only in the vicinity of the ends (leading edge 32 and/or trailing edge 33), as shown in FIG. 5.

The profile of the inner/outer face of a blade or an airfoil is defined as the surface geometry of said face. For example, the profiles of the inner face 15 of the first airfoil and of the inner face 24 of the second airfoil are identical, and the profiles of the outer face 14 of the first airfoil and of the outer face 25 of the second airfoil are identical. Nevertheless, the different shape of the blade 100 of the invention compared with a single-airfoil blade leads to a modification to the aerodynamic characteristics of the blade 100. Advantageously, the outer face 14 of the first airfoil 10, the inner face 15 of the first airfoil 10, the inner face 24 of the second airfoil 20, and the outer face 25 of the second airfoil 20 all have profiles that are different, such that the flow of air in the space 40 between the first airfoil 10 and the second airfoil 20 and around the blade 100 is optimized. Furthermore, the profile of the outer face 14 of the first airfoil 10 is different from the profile of the convex face 4 of a single-airfoil blade, and the profile of the outer face 25 of the second airfoil 20 is different from the profile of the concave face 5 of a single-airfoil blade of the prior art. In particular, the profiles of the inner and outer faces of the first airfoil 10 and the profiles of the inner and outer faces of the second airfoil 20 differ respectively from the profiles of the inner and outer faces of a first airfoil and the profiles of the inner and outer faces of a second airfoil of the kind placed close to each other without any connecting strips 30 between them.

The strips 30 extend from the leading edge 102 to the trailing edge 103 of the blade 100, as shown in FIG. 5. Alternatively, the strips 30 may begin at a certain distance from the leading edge 102, extending as far as the trailing edge 103, as shown in FIG. 4. Thus, the leading edges 32 of the strips 30 begin at a position that is set back by a distance d from the leading edge 102 of the blade 100. By way of example, this distance d is less than 10% of the distance between the leading edge 102 and the trailing edge 103.

The plane or the surface containing a strip 30 is substantially perpendicular to the inner faces 15, 24 of the airfoils joined together by the strip 30. Alternatively, a strip 30 may twist about the median curve joining the leading edge 32 of the strip to its trailing edge 33. Such twisting serves to ensure that the strips 30 follow substantially the streamlines that would be followed by the flow of air in the space 40 between the first airfoil 10 and the second airfoil 20 were the strips 30 not present, so as to minimize disturbance to this flow of air.

The blade may be made of a variety of materials: steel, superalloy based on nickel or cobalt, titanium alloy, aluminum alloy, or a composite material with a matrix, e.g. a polymer, ceramic, or metal matrix reinforced by fibers, e.g. fibers of carbon, kevlar, glass, or metal.

The blade 100 of the invention can be fabricated using a variety of methods, depending on the material constituting the blade 100.

In the above description, the blade 100 has two airfoils. Alternatively, the blade 100 could have more than two airfoils. For example, the blade 100 could also have a third airfoil situated between the first airfoil 10 and the second airfoil 20, the third airfoil possessing first and second faces extending between the leading edge 102 and the trailing edge 103 of the blade 100, the first face being connected to the inner face 15 of the first airfoil 10 at least by one spacer strip 30, and the second face is also connected to the inner face 24 of the second airfoil 20 at least by said spacer strip 30.

Thus, the blade 100 has three airfoils, the third airfoil being situated between the first airfoil 10 and the second airfoil 20. These three airfoils are aligned side by side so that, over substantially its entire area, the concave face 15 of the first airfoil 10 faces the convex face (first face) of the third airfoil, and, over substantially its entire area, the convex face 24 of the second airfoil 20 faces the concave face of the third airfoil. The strips 30 connecting the first airfoil 10 to the second airfoil 20 pass through the third airfoil (or become part of said third airfoil where they intersect said third airfoil, depending on the way in which the blade is fabricated). It may also be considered that each strip 30 is made up of two portions, a first portion interconnecting the first airfoil 10 and the third airfoil, and, in alignment with said first portion, a second portion connecting the third airfoil to the second airfoil 20.

This three-airfoil blade 100 is aerodynamically more efficient than a two-airfoil blade 100 since the flow of air between the airfoils and along the outside of said blade is better guided. Consequently, it is possible to reduce the total number of blades 100 on a bladed wheel by spacing them further apart, thereby obtaining a bladed wheel that is lighter in weight than a bladed wheel made up of single-airfoil blades.

The invention applies to a turbomachine including at least one blade 100 of the invention.

The invention is described above for non-cooled low-pressure turbine rotor blades or stator vanes. The invention also applies to rotor blades or stator vanes for a non-cooled high-pressure turbine.

What is claimed is:

1. A turbomachine blade possessing a leading edge and a trailing edge, wherein the blade comprises a first airfoil possessing an inner face and an outer face extending between said leading edge and said trailing edge, a second airfoil possessing an inner face and an outer face extending between said leading edge and said trailing edge, said first airfoil and said second airfoil being in side-by-side alignment such that, over substantially its entire area, said inner face of the first airfoil faces said inner face of the second airfoil, and at least one spacer strip interconnecting said inner face of the first airfoil and said inner face of the second airfoil, said at least one strip extending to said trailing edge.

2. A blade according to claim 1, including at least three strips.

3. A blade according to claim 2, including a first strip situated in the range 0% to 30% up the height of the blade, a last strip situated in the range 70% and 100% up the height of the blade, and a strip situated substantially halfway up the height of the blade, a height of 0% corresponding to the radially-inner end of the blade and a height of 100% corresponding to the radially-outer end of the blade.

4. A blade according to claim 1, wherein the thickness of said at least one strip increases from its middle towards the leading edge of said at least one strip such that said leading edge forms a sharp edge.

5. A blade according to claim 1, wherein the thickness of said at least one strip decreases from its middle towards the trailing edge of said at least one strip such that said trailing edge forms a sharp edge.

6. A blade according to claim 1, wherein said outer face of the first airfoil, said inner face of the first airfoil, said inner face of the second airfoil, and said outer face of the second airfoil all have different profiles.

7. A blade according to claim 1, wherein the distance between said inner face of the first airfoil and said inner face of the second airfoil is no greater than three times the maximum thickness of said first or second airfoil.

8. A blade according to claim 7, wherein the distance is less than 15 mm.

9. A blade according to claim 1, wherein at least one of said strips is rectilinear.

10. A blade according to claim 1, wherein at least one of said strips possesses curvature in at least one plane extending in the height direction of said blade.

11. A blade according to claim 1, further comprising a third airfoil situated between said first airfoil and said second airfoil, said third airfoil possessing a first face and a second face extending between said leading edge and said trailing edge of the blade, said first face being connected to said inner face of the first airfoil by said at least one strip, and said second face being connected to the inner face of the second airfoil by said at least one strip.

12. A bladed wheel including on its circumference a series of blades according to claim 1.

13. A bladed wheel according to claim 12, wherein said strips follow substantially the streamlines that would be followed by the flow of air in the space between the first airfoil and the second airfoil if said strips were not present, so as to minimize disturbance to said flow of air.

14. A turbomachine including at least one blade according to claim 1.

* * * * *